US008272761B2

(12) United States Patent
Lin et al.

(10) Patent No.: US 8,272,761 B2
(45) Date of Patent: Sep. 25, 2012

(54) LED LAMP

(75) Inventors: Ming Feng Lin, Shenzhen (CN); Wei Wang, Shenzhen (CN); Ping Lin Zhao, Shenzhen (CN); Song Lei, Shenzhen (CN)

(73) Assignee: Unilumin Group Co., Ltd., Shenzhen (CN)

( * ) Notice: Subject to any disclaimer, the term of this patent is extended or adjusted under 35 U.S.C. 154(b) by 345 days.

(21) Appl. No.: 12/778,143

(22) Filed: May 12, 2010

(65) Prior Publication Data

US 2011/0176310 A1 Jul. 21, 2011

(30) Foreign Application Priority Data

Jan. 15, 2010 (CN) ..... 2010 2 0056627 U

(51) Int. Cl.
*F21S 4/00* (2006.01)

(52) U.S. Cl. ..... 362/249.02; 362/227; 362/225

(58) Field of Classification Search ..... 362/249.01–249.06, 227, 217.01, 362/225

See application file for complete search history.

(56) References Cited

U.S. PATENT DOCUMENTS 5,400,228 A * 3/1995 Kao ..... 362/231
5,882,105 A * 3/1999 Barlow ..... 362/646
7,549,772 B2 * 6/2009 Wang ..... 362/294

* cited by examiner

*Primary Examiner* — Anne Hines

(57) ABSTRACT

An LED lamp includes a housing comprising a receptacle, first and second bossed holes in the receptacle, each bossed hole having internal threads, and a cover plate including parallel ribs projecting outward, and holes, the cover plate being secured to the receptacle by driving threaded fasteners therethrough into the second bossed holes; two opposite shoulders each formed lengthwise along a central line of an inner surface of either side of the receptacle; a PCB supported by the shoulder and the first bossed holes, the PCB being fastened in the receptacle by driving threaded fasteners therethrough into the first bossed holes; rows of units of LEDs electrically connected to the PCB wherein each row of units of LEDs is parallel to and adjacent the rib; and a waterproofing member in the housing for protecting the PCB. The LED lamp is shallow.

4 Claims, 5 Drawing Sheets

LED LAMP

BACKGROUND OF THE INVENTION

1. Field of Invention

The invention relates to LED (light-emitting diode) lighting devices and more particularly to an LED lamp with improved characteristics.

2. Description of Related Art

LEDs are widely employed in many applications. For example, there are large LED displays, LED destination displays, information signs, etc. available. A typical LED display comprises a housing, a PCB (printed circuit board) in the housing, one or more LEDs in the housing and electrically connected to the PCB, and a transparent cover secured to the housing. Waterproof adhesive is further applied to joining portion of the housing and the cover if the LED displays are for outdoor applications.

However, a number of drawbacks have found in the typical LED displays. For example, its thickness is no less than 230 mm. The thickness is excessive from some point of view. Alternatively, a portion of the housing can be replaced with brackets for decreasing thickness. However, it is not waterproof and its assembly and disassembly are not convenient. Also, it is visually unattractive. This type of LED displays is sold at low price as cheap products. Thus, the need for improvement still exists.

SUMMARY OF THE INVENTION

It is therefore one object of the invention to provide an LED lamp comprising a housing comprising a receptacle, a plurality of first and second bossed holes in the receptacle, each of the first and second bossed hole having internal threads, and a cover plate including a plurality of parallel ribs projecting outward, and a plurality of holes, the cover plate being secured to the receptacle by driving a plurality of threaded fasteners therethrough into the second bossed holes; two opposite shoulders each formed lengthwise along a central line of an inner surface of either side of the receptacle; a PCB supported by the shoulder and the first bossed holes, the PCB being fastened in the receptacle by driving a plurality of threaded fasteners therethrough into the first bossed holes; a plurality of rows of a plurality of units of LEDs electrically connected to the PCB wherein each row of units of LEDs is parallel to and adjacent the rib; and waterproofing means in the housing for protecting the PCB.

The above and other objects, features and advantages of the invention will become apparent from the following detailed description taken with the accompanying drawings.

DETAILED DESCRIPTION OF THE INVENTION

Figure 1:
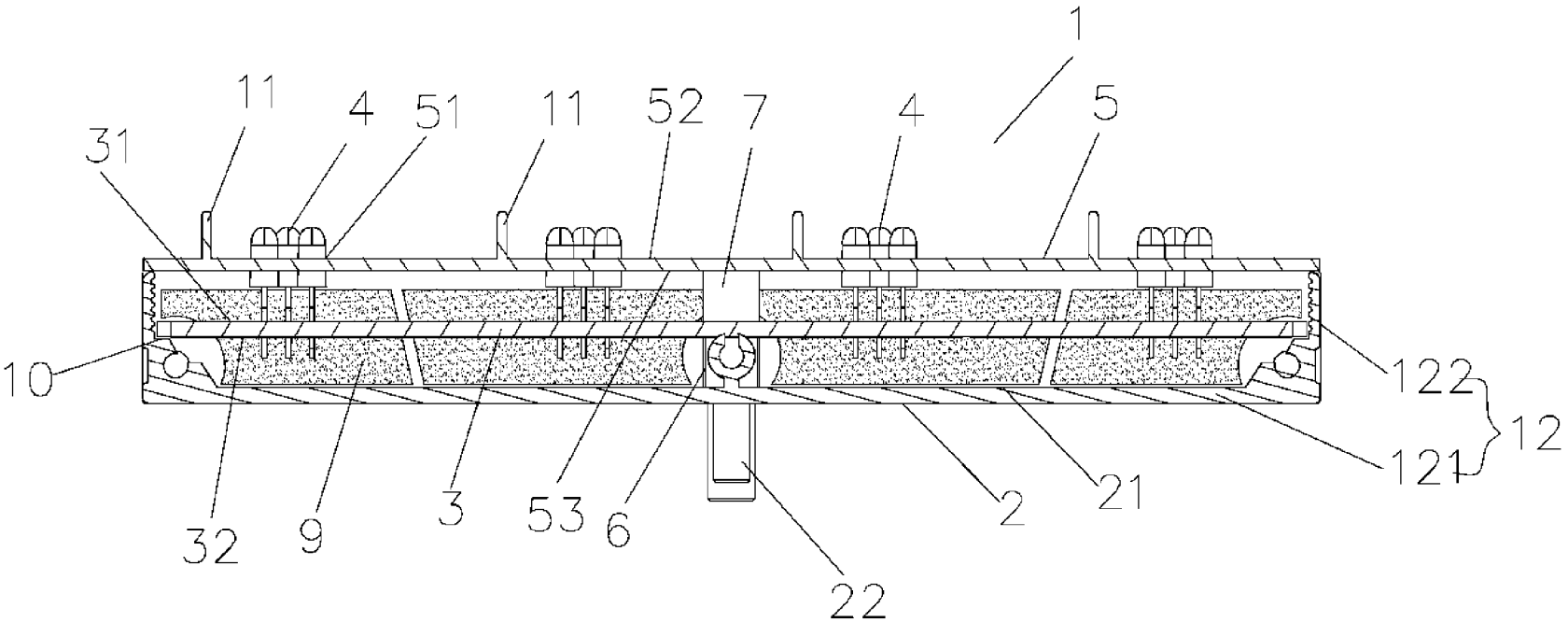
FIG. 1 is a longitudinal sectional view of an LED lamp according to the invention.
Figure 2:
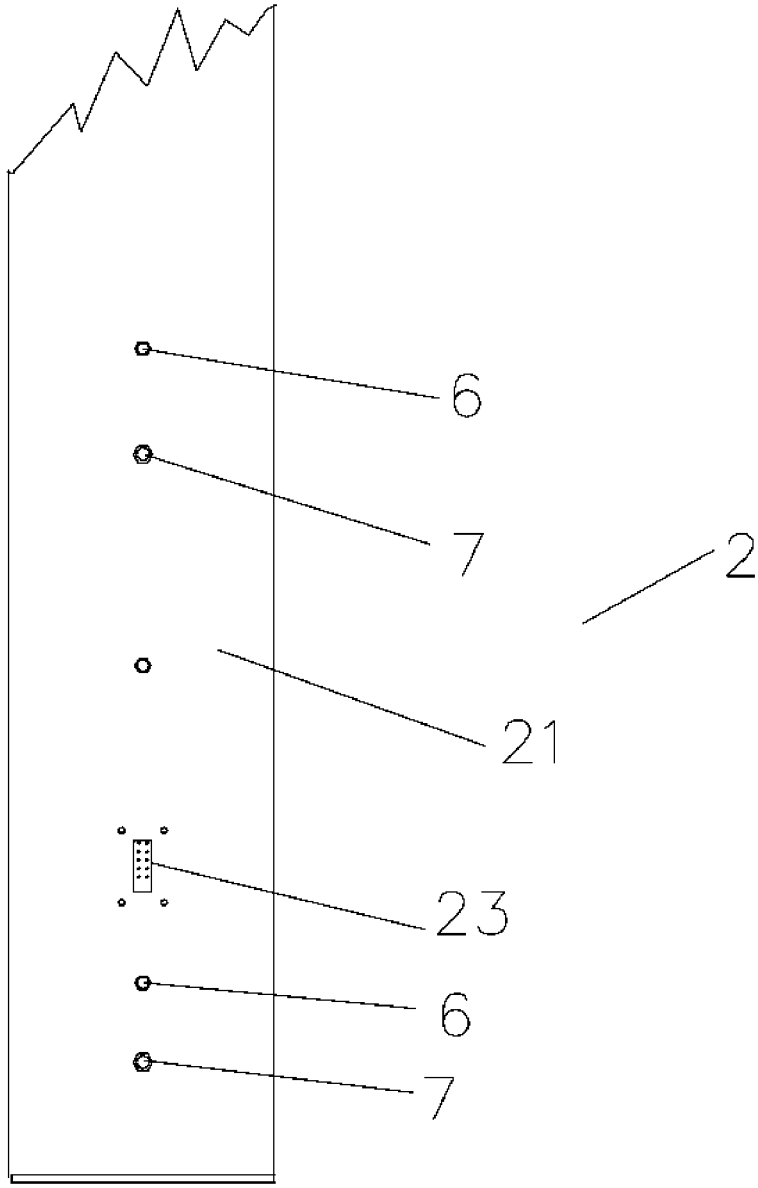
FIG. 2 is a fragmentary top view of the LED lamp.
Figure 3:
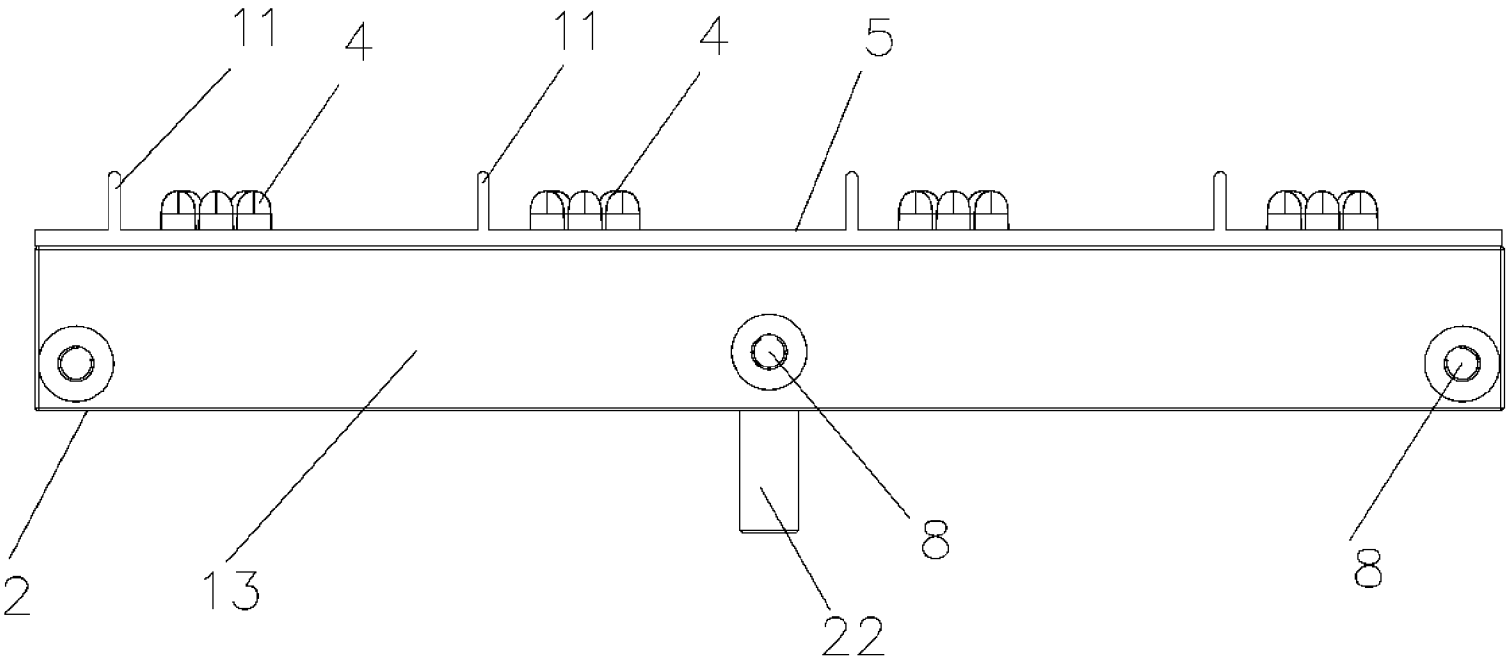
FIG. 3 is a side elevation of FIG. 1.
Figure 4:
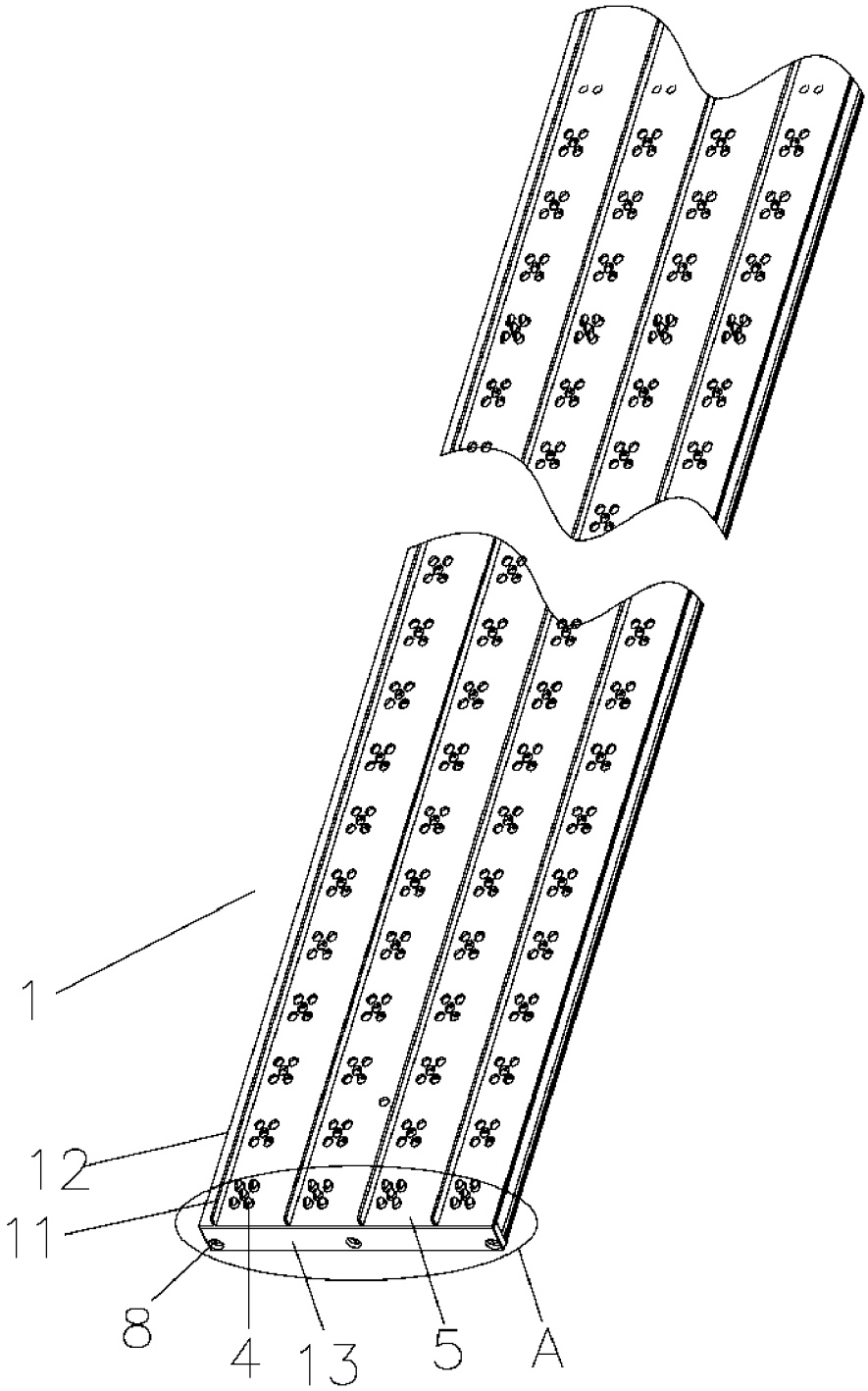
FIG. 4 is a perspective view of a portion of the LED lamp.
Figure 5:
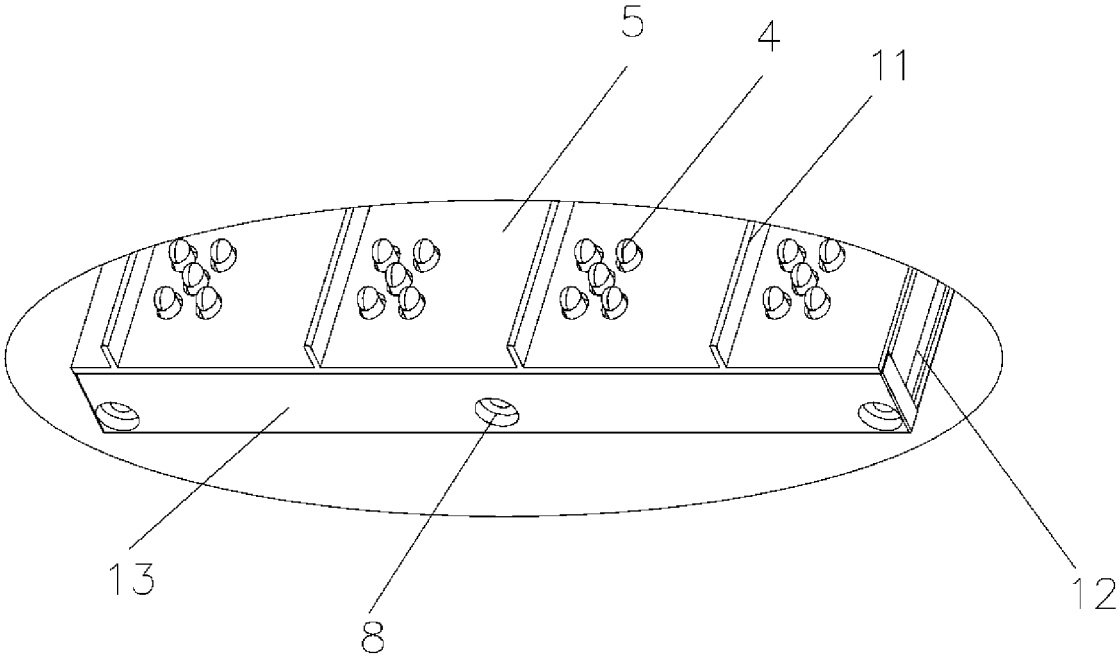
FIG. 5 is a detailed view of the oval A in FIG. 4.

Referring to FIGS. 1 to 5, an LED lamp 1 in accordance with the invention comprises the following components as discussed in detail below.

A rectangular housing 2 comprises a shallow receptacle 21, threaded bolts 22 projecting out of the receptacle 21, and a socket 23 on the receptacle 21. A plurality of first and second bossed holes 6, 7 are provided on the receptacle 21 and are in the housing 2. A cover plate 5 is opposite to the receptacle 21. The cover plate 5 comprises four parallel ribs 11 on a plate member 52 and a plurality of holes 51 on the plate member 52. The ribs 11 serve to increase the structural strength of the cover plate 5.

Two opposite shoulders 10 each forms lengthwise along a central line of an inner surface of either side 12. Bottom surface 32 of a printed circuit board (PCB) 3 is supported by the first bossed holes 6 and the shoulders 10. Also, the second bossed holes 7 pass the bottom surface 32 and top surface 31 of the PCB 3 to urge against a bottom surface 53 of the cover plate 5. External power can be supplied to the PCB 3 by inserting a plug (not shown) into the socket 23 which is electrically connected to the PCB 3.

A plurality of threaded fasteners (e.g., screws) 8 can be driven into internal threads of the second bossed holes 7 to fasten the cover plate 5 and the housing 2 together. A plurality of threaded fasteners (e.g., screws) 8 can be driven into internal threads of the first bossed holes 6 to fasten the PCB 3 within the housing 2.

Four rows of a plurality of units each having five LEDs 4 are provided parallel to the ribs 11. The five LEDs 4 are fastened in the hole 51. LEDs 4 are electrically connected to the PCB 3. Heights of the ribs 11 are greater than that of the exposed portions of the LEDs 4. The housing 2 has two end surfaces 13. Either side 12 and a reinforced member 121 integrally formed on the receptacle 21 consist of the major portion of a main body 12. A plurality of threaded fasteners (e.g., screws) 8 are driven into through the end surfaces 13 to secure same to the housing 2.

The assembly of the LED lamp 1 can be briefed as below. First, assemble the PCB 3 in the housing 2. Next, fill interior of the housing 2 with waterproof epoxy adhesive 9 for further fastening the PCB 3 and preventing water from entering the housing 2. Otherwise, it may cause short circuit. Next, secure the cover plate 5 onto the housing 2. Finally, mount the LED lamp 1 on, for example, a wall.

For reducing weight and the manufacturing cost, both the receptacle 21 and the cover plate 5 are made of aluminum, or the receptacle 21 is made of wood and the cover plate 5 is formed of aluminum. Other lightweight materials for the receptacle 21 and the cover plate 5 are also contemplated by the invention. The threaded bolts 22 can be driven into a hard surface for mounting the housing 2 thereon. Preferably, the thickness of the LED lamp 1 is no more than 35 mm much less than the typical type of LED lamps.

While the invention has been described in terms of preferred embodiments, those skilled in the art will recognize that the invention can be practiced with modifications within the spirit and scope of the appended claims.

What is claimed is:

1. An LED lamp comprising:

a housing comprising a receptacle, a plurality of first and second bossed holes in the receptacle, each of the first and second bossed hole having internal threads, and a cover plate including a plurality of parallel ribs projecting outward, and a plurality of holes, the cover plate being secured to the receptacle by driving a plurality of threaded fasteners therethrough into the second bossed holes;

two opposite shoulders each formed lengthwise along a central line of an inner surface of either side of the receptacle;

a printed circuit board (PCB) supported by the shoulder and the first bossed holes, the PCB being fastened in the receptacle by driving a plurality of threaded fasteners therethrough into the first bossed holes;

a plurality of rows of a plurality of units of light-emitting diodes (LEDs) electrically connected to the PCB wherein each row of units of LEDs is parallel to and adjacent the rib; and waterproofing means in the housing for protecting the PCB.

2. The LED lamp of claim 1, wherein both the receptacle and the cover plate are formed of aluminum.

3. The LED lamp of claim 1, wherein the receptacle is formed of wood and the cover plate is formed of aluminum.

4. The LED lamp of claim 1, wherein thickness of the housing is no more than 35 mm.

* * * * *